US005572934A

United States Patent [19]

Aldridge et al.

[11] Patent Number: 5,572,934

[45] Date of Patent: Nov. 12, 1996

[54] SEAFOOD EATING AND CLEANING TABLE

[76] Inventors: Richard Aldridge; Kathy Aldridge, both of 841 Ginette Dr., Gretna, La. 70056

[21] Appl. No.: 564,864

[22] Filed: Nov. 30, 1995

[51] Int. Cl.[6] ..... A47B 85/00

[52] U.S. Cl. ..... 108/25; 108/24

[58] Field of Search ..... 108/25, 24, 26, 108/26.2, 50; 220/910, 909; 312/229, 228, 232

[56] References Cited

U.S. PATENT DOCUMENTS

| | | | |
|---|---|---|---|
| 1,106,057 | 8/1914 | Puckett | 755/457 |
| 1,579,823 | 4/1926 | Langguth | 108/26 X |
| 2,022,591 | 11/1935 | Everitt | 108/24 X |
| 2,506,532 | 2/1950 | Wilson | 17/44 |
| 2,508,802 | 5/1950 | Schade | 108/26 |
| 2,683,639 | 7/1954 | Brenny | 108/26 X |
| 2,897,973 | 4/1959 | Sizemore . | |
| 2,942,921 | 6/1960 | Rachman et al. | 108/26 |
| 3,745,303 | 7/1973 | Epperson et al. | 108/25 X |
| 4,747,352 | 5/1988 | Guidry et al. | 108/50 |
| 4,872,410 | 10/1989 | Lilly | 108/26 |
| 5,098,174 | 3/1992 | Worthley | 108/26 X |
| 5,226,621 | 7/1993 | Skoff | 108/26 X |
| 5,327,838 | 7/1994 | Beltman | 108/25 |

*Primary Examiner*—Jose V. Chen
*Attorney, Agent, or Firm*—Joseph N. Breaux

[57] ABSTRACT

A table is provided of the type for eating and cleaning seafood thereon. The seafood eating and cleaning table comprises: a perforated table top forming a hatch therethrough, a rail formed about the perimeter of the perforated table top, a sloped drip pan connected beneath the perforated table top that slopes toward an aperture formed therethrough which is in alignment with the hatch, legs attached to the perforated table top, and a perforated hatch door removably seatable within the hatch.

10 Claims, 2 Drawing Sheets

SEAFOOD EATING AND CLEANING TABLE

DESCRIPTION

1. Technical Field

The present invention relates to devices for supporting food stuff thereon and more particularly to devices for supporting food stuff thereon that have a perforated table top forming a hatch therethrough for allowing liquids to pass into a sloped drip pan sloping toward an aperture formed therethrough supportable above a trash receptacle.

2. Background Art

In South Louisiana it is a popular pastime to have weekend or afternoon boils. These boils usually involve the cooking of large quantities of crawfish, crabs or shrimp. It is common for the boiled seafood to be poured atop a conventional table covered in newspaper and at times plastic. Once the feast begins the juices and liquids from the seafood seep off the table ending up on the ground or on the floor of a home creating a attraction for ants and other insects and rodents and creating a distinct odor problem. In addition, after the feast is completed the difficult task of cleaning the pounds and mounds of empty shells from the table without spreading them and their juices all over is begun.

It would be a benefit, therefore, to have a table that is easily erected and lowered for seafood boils. It would be a further benefit, to have a table that provides a sanitary and convenient way to eat boiled seafood. It would be a still further benefit, to have a table that provides an easy means for clearing the contents held thereon into a trash receptacle.

GENERAL SUMMARY DISCUSSION OF INVENTION

It is thus an object of the invention to provide a seafood eating and cleaning table that has a perforated table top having a rail formed about the perimeter thereof, and a sloped drip pan disposed thereunder sloping from the perimeter of the table top to an aperture formed therethrough for disposing a trash receptacle thereunder.

It is a further object of the invention to provide a seafood eating and cleaning table that has a perforated table top forming a hatch therethrough, the perforated table top having a rail formed about the perimeter thereof, and a sloped drip pan disposed thereunder sloping from the perimeter of the table top to an aperture formed therethrough and aligned with the hatch for disposing a trash receptacle thereunder.

It is a still further object of the invention to provide a seafood eating and cleaning table that has a perforated hatch door disposable within the hatch formed through the perforated table top.

Accordingly, a table is provided of the type for eating and cleaning seafood thereon. The seafood eating and cleaning table comprises: a perforated table top forming a hatch therethrough, a rail formed about the perimeter of the table top, a sloped drip pan connected beneath the perforated table top that slopes toward an aperture formed therethrough which is in alignment with the hatch, legs attached to the table top, and a perforated hatch door removably seatable within the hatch.

The perforated table top may be rectangular, round or any other shape which provides access to the table for a number of people. The table top must be formed of a sturdy, rigid material such as wood, metal, or plastic. Preferably, the table top is constructed of a lightweight material such as plastic or aluminum for easy transport. The perforations formed through the table top are sized to allow free flow of liquids therethrough while preventing the passage of food stuffs being cleaned or eaten thereon. The rail is formed about the perimeter of the table top to maintain liquids and food stuff on the surface of the table top.

The perforated table top forms a hatch therethrough for disposing of waste products. The hatch may be formed through any section of the table top. Preferably, the hatch is centrally located through the table top.

A perforated hatch door is provided for covering the hatch while food stuff is being cleaned or eaten. The hatch door may be hingedly connected within the hatch or removably seatable therein.

The sloped drip pan is connected along the perimeter of the table top for containing liquids which pass through the perforations through the table top. The sloped drip pan is constructed of an impermeable material. The sloped drip pan slopes from the perimeter of the table top to an aperture formed therethrough which is aligned with the hatch formed through the perforated table top.

Legs are attached to the table top for supporting the table top above the ground a sufficient distance for disposing a trash receptacle beneath the aligned aperture and hatch. The legs may be rigidly attached to the table top or foldably or hingedly attached so that the table may be lowered and compressed for easy storage.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
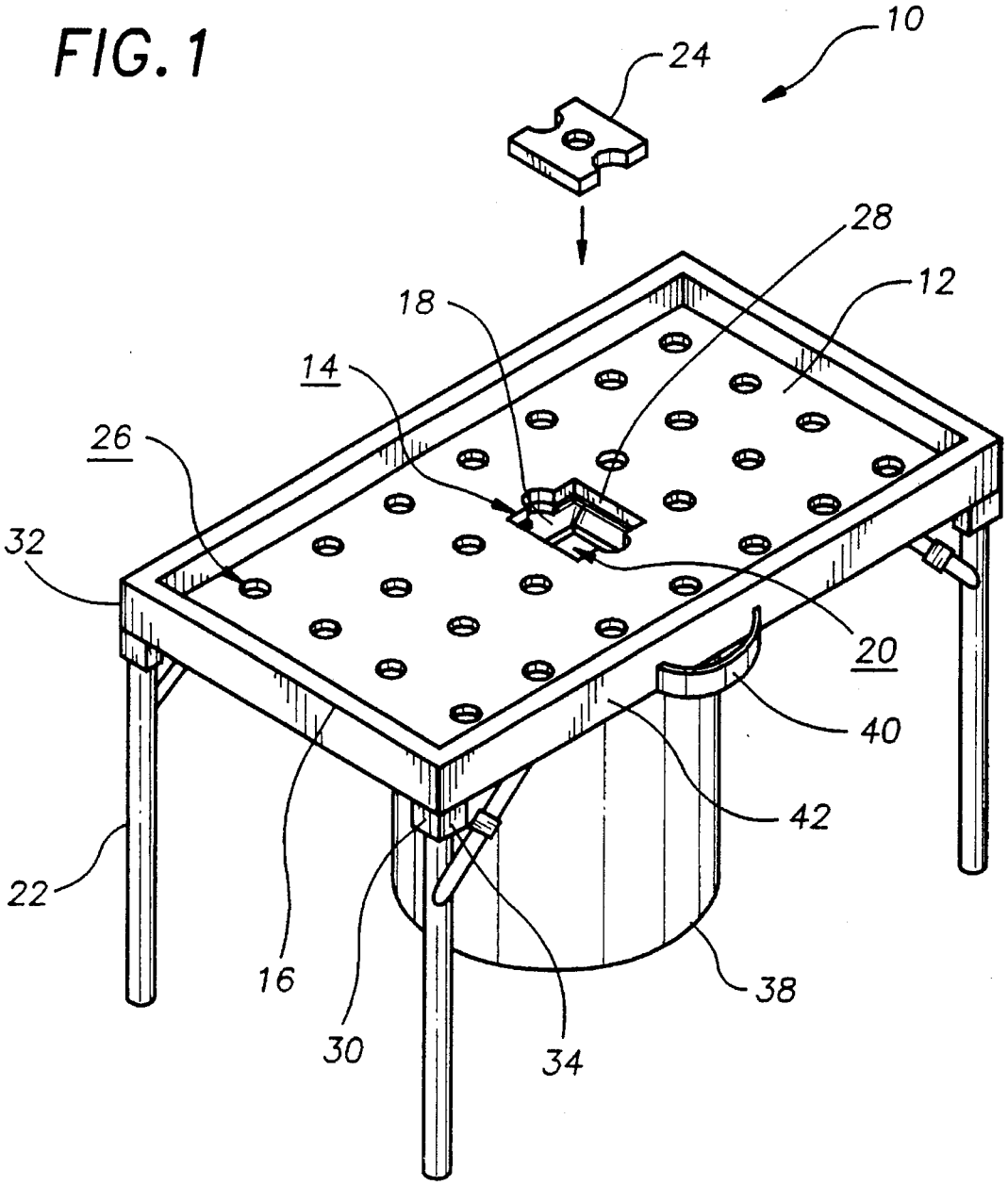
FIG. 1 is an isometric view of an exemplary embodiment of the seafood eating and cleaning table of the present invention.

FIG. 1 is an isometric view of an exemplary embodiment of the seafood eating and cleaning table of the present invention generally designated by the numeral 10. Table 10 includes a perforated table top 12 forming a hatch 14 therethrough, a rail 16, a sloped drip pan 18 forming an aperture 20 therethrough, legs 22 and a perforated hatch door 24.

Table top 12 and rail 16 are formed of unitary construction of a sturdy, rigid plastic. Rail 16 is formed about the perimeter of rectangular table top 12 for maintaining liquids thereon. Perforations 26 are sized to allow liquid to pass freely therethrough without allowing small items such as crawfish tails or shrimp to pass.

Hatch 14 is centrally located and formed through table top 12 for disposing waste products. A lip 28 extends horizontally from the lower edge of the perimeter of hatch 14 for seating perforated hatch door 24 within hatch 14. Hatch door 24 is sized so as to be removably seated within hatch 14 forming a continuous planar perforated table top 12.

A bracket 30 extends from each corner 32 of table top 12. A leg 22 is foldably attached to each bracket 30 by a pivot pin 34. A locking mechanism 36 for maintaining legs 22 in a locked, vertical position is in connection between each leg 22 and rail 16 of table top 12. Legs 22 are of a sufficient length to allow for disposal of a trash receptacle 38 under aperture 20 formed through sloped drip pan 18.

A handle 40 is connected to an outer longitudinal side 42 of rail 16 of table top 12. When legs 22 are folded handle 40 allows a user (not shown) to easily transport seafood eating and cleaning table 10.

Figure 2:
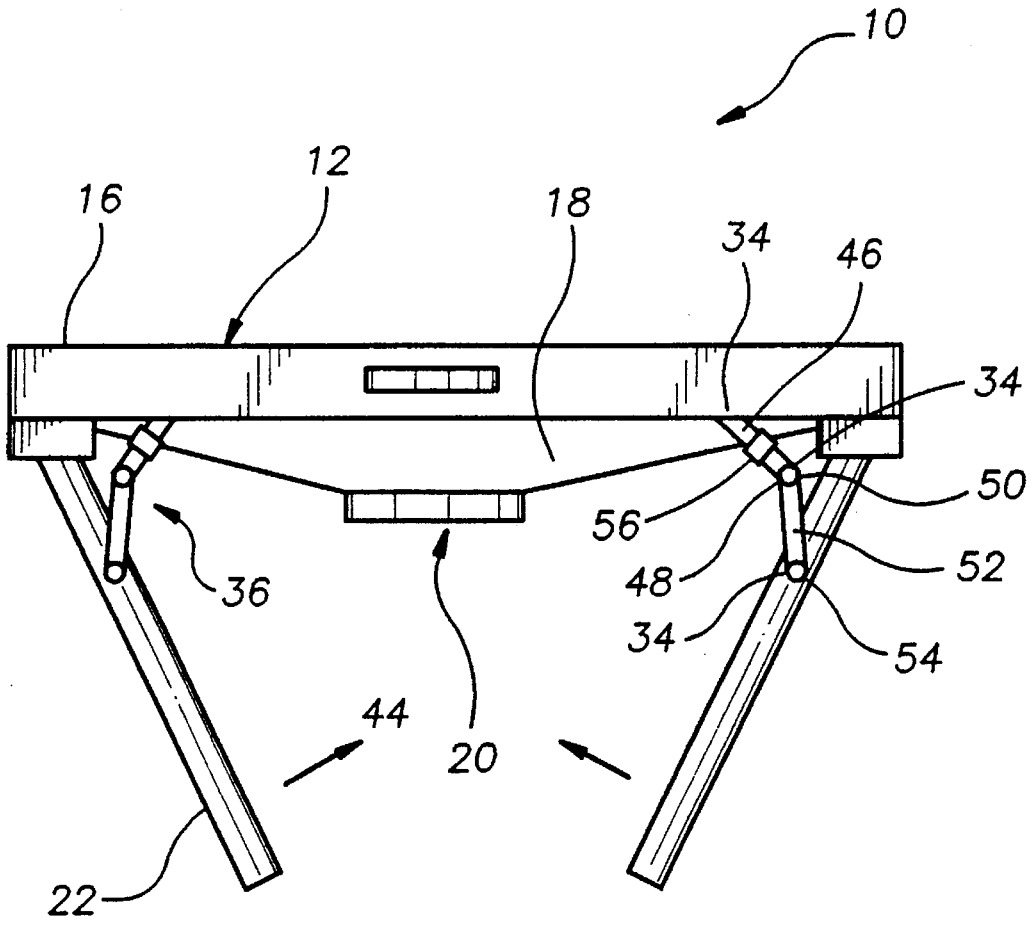
FIG. 2 is a side view of the seafood eating and cleaning table.

FIG. 2 is a side view of seafood eating and cleaning table 10. As shown, legs 22 are foldable from an extended position, as shown in FIG. 1, in the direction of arrows 44 to a position beneath table top 12 (not shown). Locking mechanism 36 includes a first arm 46 having a first end (not shown ) hingedly connected to rail 16 of table top 12 by a pivot pin 34 and a second end 48 pivotedly connected to a terminal end 50 of a second arm 52 by a pivot pin 34, an initial end 54 of second arm 52 is hingedly connected to leg 22 by a pivot pin 34. A clasp 56 is slidably disposed about first arm 46 for disposing over second end 48 of first arm 46 and terminal end 50 of second arm 52 when arms 46 and 52 are aligned locking legs 22 in an extended position as shown in FIG. 1.

Sloped drip pan 18 is formed of the same material as table top 12. Drip pan 18 is disposed beneath table top 12 with aperture 20 aligned with hatch 14 of table top 12 as shown in FIG. 1. Drip pan 18 is connected along the perimeter of table top 12 and slopes therefrom to centrally located aperture 20.

Use of seafood eating and cleaning table 10 is now described with reference to FIGS. 1 and 2. Table 10 is erected by folding legs 22 into the extended position and locking in place with locking mechanisms 36. Perforated hatch door 24 is seated within hatch 14. Trash receptacle 38 is place beneath table top 12 and aligned witch hatch 14 and aperture 20. Food stuffs such as crawfish, crabs or shrimp may then be placed upon table top 12 for cleaning or eating, the associated liquids flowing through perforations 26 into sloped drip pan 18 and through aperture 20 into trash receptacle 38. Upon completion of eating or cleaning, perforated hatch door 24 may be removed allowing the remaining scraps and waste material to be disposed through hatch 14 and aperture 20 into trash receptacle 38. Table top 12 and drip pan 18 may then be easily cleaned with soap and water. Table 10 may then be lowered and compressed by folding legs 22 beneath table top 12 and easily transported using handle 40.

It can be seen from the preceding description that a device for supporting food stuff thereon which has a perforated table top having a rail formed about the perimeter thereof, and a sloped drip pan disposed thereunder sloping from the perimeter of the table top to an aperture formed therethrough for disposing a trash receptacle thereunder, a hatch formed through the perforated table top and the aperture formed through the drip pan being aligned therewith, and has a perforated hatch door disposable within the hatch formed through the perforated table top, has been provided.

It is noted that the embodiment of the seafood eating and cleaning table described herein in detail for exemplary purposes is of course subject to many different variations in structure, design, application and methodology. Because many varying and different embodiments may be made within the scope of the inventive concept (s) herein taught, and because many modifications may be made in the embodiment herein detailed in accordance with the descriptive requirements of the law, it is to be understood that the details herein are to be interpreted as illustrative and not in a limiting sense.

What is claimed is:

1. A seafood eating and cleaning table comprising:

a perforated table top forming a hatch therethrough;

a rail formed about a perimeter of said perforated table top;

a sloped drip pan connected beneath said perforated table top that slopes toward an aperture formed therethrough, said aperture being in alignment with said hatch;

legs attached to said perforated table top for supporting said perforated table top a sufficient height for disposing a trash receptacle beneath said aligned hatch and aperture; and a perforated hatch door removably seatable within said hatch.

2. The seafood eating and cleaning table of claim 1, wherein:

said legs are foldably attached to said perforated table top.

3. The seafood eating and cleaning table of claim 2, further including:

a locking mechanism in connection between said leg and said perforated table top for locking said leg in an extended position.

4. The seafood eating and cleaning table of claim 3, further including:

a handle in connection with said rail.

5. The seafood eating and cleaning table of claim 1, wherein:

said perforated table top forms said hatch centrally therethrough.

6. A seafood eating and cleaning table comprising:

a perforated table top forming a hatch centrally therethrough;

a rail formed about a perimeter of said perforated table top;

a sloped drip pan connected beneath said perforated table top that slopes toward an aperture formed therethrough, said aperture being in alignment with said hatch;

legs attached to said perforated table top for supporting said perforated table top a sufficient height for disposing a trash receptacle beneath said aligned hatch and aperture; and a perforated hatch door removably seatable within said hatch.

7. The seafood eating and cleaning table of claim 6, wherein:

said legs are foldably attached to said perforated table top.

8. The seafood eating and cleaning table of claim 7, further including:

a locking mechanism in connection between said leg and said perforated table top for locking said leg in an extended position.

9. The seafood eating and cleaning table of claim 8, further including:

a handle in connection with said rail.

10. A seafood eating and cleaning table comprising:

a perforated table top forming a hatch centrally therethrough;

a rail formed about a perimeter of said perforated table top;

a sloped drip pan connected beneath said perforated table top that slopes toward an aperture formed therethrough, said aperture being in alignment with said hatch;

legs foldably attached to said perforated table top for supporting said perforated table top a sufficient height for disposing a trash receptacle beneath said aligned hatch and aperture when said legs are in an extended position;

a locking mechanism in connection between said leg and said perforated table top for locking said leg in an extended position;

a perforated hatch door removably seatable within said hatch; and a handle in connection with said rail.

* * * * *